US009349354B1

(12) United States Patent
Galloup

(10) Patent No.: US 9,349,354 B1
(45) Date of Patent: May 24, 2016

(54) ACOUSTIC WEIGHT SYSTEM AND A STRINGED MUSICAL INSTRUMENT INCLUDING THE SAME

(71) Applicant: Guitar Hospital, Inc., Big Rapids, MI (US)

(72) Inventor: Bryan John Galloup, Big Rapids, MI (US)

(73) Assignee: Guitar Hospital, Inc., Big Rapids, MI (US)

( * ) Notice: Subject to any disclaimer, the term of this patent is extended or adjusted under 35 U.S.C. 154(b) by 0 days.

(21) Appl. No.: 14/611,027

(22) Filed: Jan. 30, 2015

(51) Int. Cl.
*G10D 3/00* (2006.01)
*G10D 3/06* (2006.01)

(52) U.S. Cl.
CPC ... *G10D 3/00* (2013.01); *G10D 3/06* (2013.01)

(58) Field of Classification Search
CPC ..... G10D 3/02; G10D 1/08; G10D 3/00; G10D 1/00; G10D 1/02; Y10T 156/10; B27D 1/08; B27H 1/00; B29C 44/02; B29C 44/12
USPC ..... 84/267, 290, 291
See application file for complete search history.

(56) References Cited

U.S. PATENT DOCUMENTS

| | | | | |
|---|---|---|---|---|
| 2,068,078 | A * | 1/1937 | Samuelson | G10D 3/02 84/276 |
| 3,669,214 | A | 6/1972 | Matsuura et al. | |
| 4,325,280 | A | 4/1982 | Hardy | |
| 4,741,238 | A * | 5/1988 | Carriveau | G10D 1/085 84/291 |
| 5,561,254 | A | 10/1996 | Huffer | |
| 6,087,568 | A | 7/2000 | Seal | |
| 7,145,064 | B2 | 12/2006 | Geiger | |
| 7,678,979 | B1 | 3/2010 | Roop | |
| 7,687,695 | B2 | 3/2010 | DeJule | |
| 7,687,696 | B2 | 3/2010 | Fox | |
| 8,247,678 | B1 | 8/2012 | Ivy | |
| 2008/0110318 | A1 | 5/2008 | Fox | |

* cited by examiner

*Primary Examiner* — Kimberly Lockett
(74) *Attorney, Agent, or Firm* — The Law Office of Patrick F. O'Reilly, III, LLC

(57) ABSTRACT

An acoustic weight system for a stringed musical instrument is disclosed herein. The acoustic weight system includes one or more acoustic braces, tone bars, or ribs configured to be attached to one or more walls of a musical instrument body; and one or more weights coupled to the one or more acoustic braces, tone bars, or ribs by attachment means. The acoustic weight system is configured to change a resonant frequency of the one or more walls of the musical instrument body in order to modify a sound and/or tone of the stringed musical instrument. A stringed musical instrument, which includes acoustic weight system, is also disclosed herein.

17 Claims, 12 Drawing Sheets

ACOUSTIC WEIGHT SYSTEM AND A STRINGED MUSICAL INSTRUMENT INCLUDING THE SAME

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to an acoustic weight system. More particularly, the invention relates to an acoustic weight system that is utilized in a stringed musical instrument.

2. Background

Acoustic musical instruments, such as guitars, have a pitch frequency or resonant frequency that affects the nature of the sound that is emitted from the instruments. Currently, with such acoustic musical instruments, the pitch or resonant frequency of a plate cannot generally be changed once the instrument is constructed other than by removing internal brace material. However, the removal of internal brace material will only lower the resonant frequency of the plate.

Therefore, what is needed is an acoustic weight system that is capable of selectively raising and lowering the resonant frequency of the acoustic instrument plate or sidewall by the addition and removal of one or more weights. Moreover, an acoustic weight system is needed that includes one or more weights that are capable of being easily attached to one or more acoustic braces, tone bars, or ribs. Furthermore, there is a need for a stringed musical instrument that includes an acoustic weight system that enables the resonant frequency of the acoustic instrument plate to be easily adjusted by a user thereof.

BRIEF SUMMARY OF EMBODIMENTS OF THE INVENTION

Accordingly, the present invention is directed to an acoustic weight system and a stringed musical instrument including the same that substantially obviates one or more problems resulting from the limitations and deficiencies of the related art.

In accordance with one or more embodiments of the present invention, there is provided an acoustic weight system for a stringed musical instrument. The acoustic weight system includes one or more acoustic braces, tone bars, or ribs configured to be attached to one or more walls of a musical instrument body; and one or more weights coupled to the one or more acoustic braces, tone bars, or ribs by attachment means. The acoustic weight system is configured to change a resonant frequency of the one or more walls of the musical instrument body in order to modify a sound and/or tone of the stringed musical instrument.

In a further embodiment of the present invention, at least one of the one or more acoustic braces, tone bars, or ribs comprises a curved outer surface with one or more generally flat portions that provide mounting surfaces for respective ones of the one or more weights.

In yet a further embodiment, at least one of the one or more acoustic braces, tone bars, or ribs comprises a plurality of the weights coupled to a surface of the at least one of the one or more acoustic braces, tone bars, or ribs.

In still a further embodiment, at least one of the one or more weights comprises one of: (i) a disk-shaped weight, (ii) an elongated weight in the form of a rectangular bar, and (iii) an elongated weight in the form of a cylindrical rod.

In yet a further embodiment, the attachment means comprises one of: (i) a threaded fastener device, (ii) an adhesive, and (iii) one or more magnets.

In accordance with one or more other embodiments of the present invention, there is provided a stringed musical instrument that includes a musical instrument body with a soundboard, one or more sidewalls, and a back wall, the soundboard being coupled to the one or more sidewalls; a neck having a first end portion and a second end portion, the second end portion of the neck being coupled to the musical instrument body; a plurality of strings extending from the first end portion of the neck to the soundboard of the musical instrument body; and an acoustic weight system including one or more acoustic braces, tone bars, or ribs attached to at least one of the one or more sidewalls and the back wall of the musical instrument body, the acoustic weight system further including one or more weights coupled to the one or more acoustic braces, tone bars, or ribs by attachment means, the acoustic weight system being configured to change a resonant frequency of the at least one of the one or more sidewalls and the back wall of the musical instrument body in order to modify a sound and/or tone of the stringed musical instrument.

In a further embodiment of the present invention, the one or more sidewalls of the musical instrument body comprise a curved sidewall extending about a periphery of the soundboard; and wherein the acoustic weight system comprises a plurality of the acoustic braces, tone bars, or ribs spaced apart along an interior surface of the curved sidewall of the musical instrument body.

In yet a further embodiment, the acoustic weight system comprises a plurality of the acoustic braces, tone bars, or ribs spaced apart along an interior surface of the back wall of the musical instrument body.

In still a further embodiment, at least one of the one or more acoustic braces, tone bars, or ribs of the acoustic weight system comprises a curved outer surface with one or more weight support portions, each of the one or more weight support portions including a generally flat portion that provides a mounting surface for a respective one of the one or more weights.

In yet a further embodiment, at least one of the one or more weight support portions further includes a pair of spaced-apart generally planar sidewalls, each of the pair of spaced-apart generally planar sidewalls having diagonally extending sidewalls disposed on respective opposite sides thereof.

In still a further embodiment, at least one of the one or more acoustic braces, tone bars, or ribs of the acoustic weight system comprises a plurality of the weights coupled to a surface of the at least one of the one or more acoustic braces, tone bars, or ribs, each of the plurality of the weights being spaced apart from one another along a length of the at least one of the one or more acoustic braces, tone bars, or ribs.

In yet a further embodiment, the at least one of the one or more acoustic braces, tone bars, or ribs of the acoustic weight system comprises a curved outer surface with a plurality of weight support portions, each of the plurality of weight support portions including a generally flat portion that provides a mounting surface for a respective one of the plurality of the weights.

In still a further embodiment, the at least one of the one or more weights of the acoustic weight system comprises one of: (i) a disk-shaped weight, (ii) an elongated weight in the form of a rectangular bar, and (iii) an elongated weight in the form of a cylindrical rod.

In yet a further embodiment, the attachment means of the acoustic weight system comprises one of: (i) a threaded fastener device, (ii) an adhesive, and (iii) one or more magnets.

In still a further embodiment, the attachment means of the acoustic weight system comprises a threaded fastener device in the form of a threaded screw or bolt with a plurality of external threads, the attachment means further comprising a threaded insert disposed in an aperture in the one or more acoustic braces, tone bars, or ribs, the threaded insert including a plurality of internal threads configured to threadingly engage with the plurality of external threads on the threaded screw or bolt.

In yet a further embodiment, the attachment means of the acoustic weight system comprises a threaded fastener device in the form of a self-threading screw with a plurality of external threads, the plurality of external threads on the self-threading screw configured to engage with an interior surface of an aperture in the one or more acoustic braces, tone bars, or ribs.

In still a further embodiment, the attachment means of the acoustic weight system comprises one or more magnets, each of the one or more magnets received within an aperture or bore in the one or more acoustic braces, tone bars, or ribs.

In accordance with yet one or more other embodiments of the present invention, there is provided a stringed musical instrument includes a musical instrument body with a soundboard, one or more sidewalls, and a back wall, the soundboard being coupled to the one or more sidewalls; a neck having a first end portion and a second end portion, the second end portion of the neck being coupled to the musical instrument body; a plurality of strings extending from the first end portion of the neck to the soundboard of the musical instrument body; and an acoustic weight system including a plurality of acoustic braces, tone bars, or ribs attached to at least one of the one or more sidewalls and the back wall of the musical instrument body, each of the plurality of acoustic braces, tone bars, or ribs spaced apart along an interior surface of the at least one of the one or more sidewalls and the back wall, the acoustic weight system further including a plurality of weights coupled to the plurality of acoustic braces, tone bars, or ribs by attachment means, the acoustic weight system being configured to change a resonant frequency of the at least one of the one or more sidewalls and the back wall of the musical instrument body in order to modify a sound and/or tone of the stringed musical instrument.

In a further embodiment of the present invention, each of the plurality of acoustic braces, tone bars, or ribs comprises at least one of the plurality of weights coupled to a weight support portion of the acoustic brace, tone bar, or rib.

In yet a further embodiment, the weight support portion of each acoustic brace, tone bar, or rib comprises a generally flat portion that provides a mounting surface for the at least one of the plurality of weights.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Figure 1:
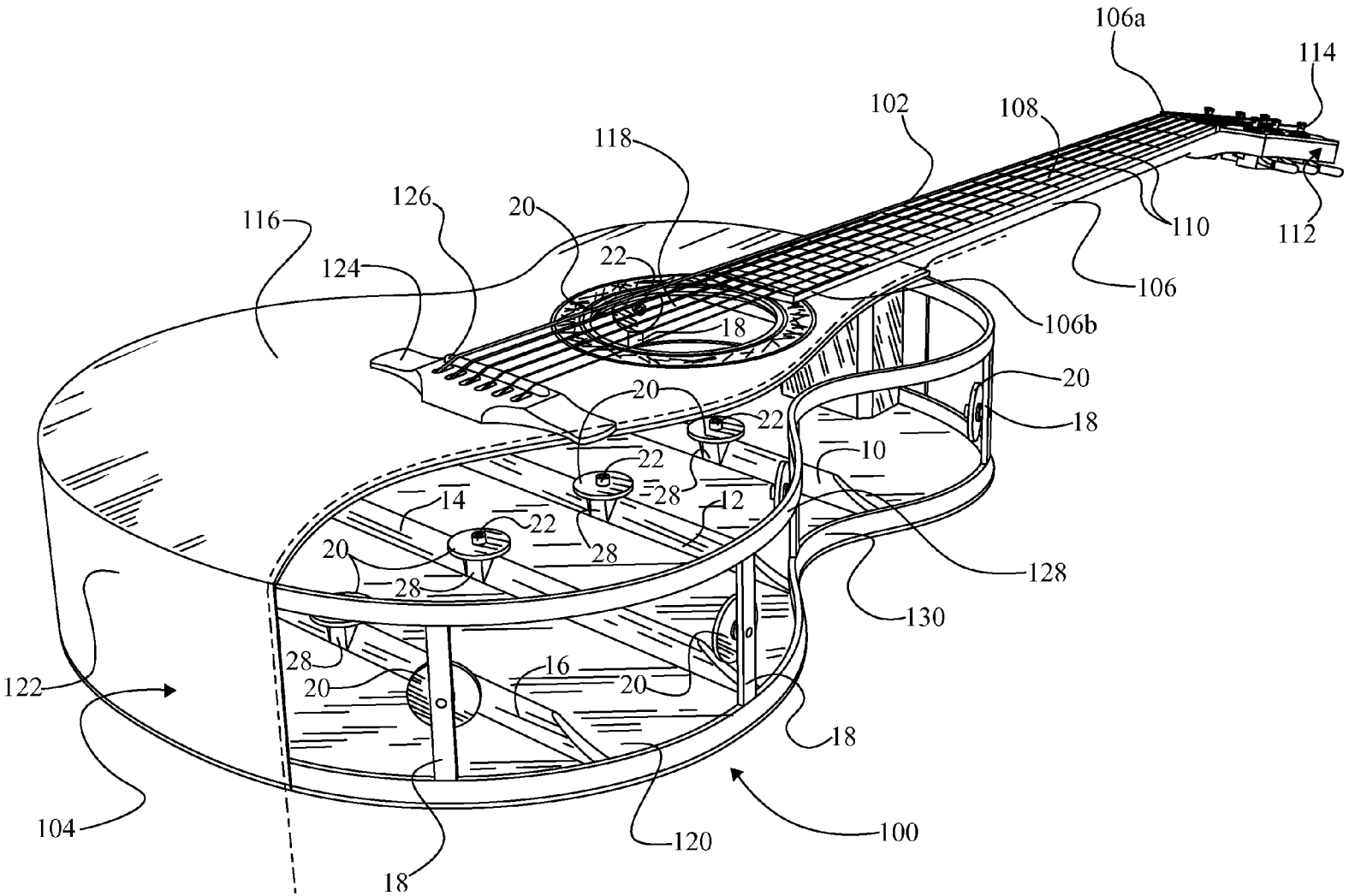
FIG. 1 is an overall cutaway perspective view of a stringed musical instrument with an acoustic weight system, according to an embodiment of the invention.

Throughout the figures, the same parts are always denoted using the same reference characters so that, as a general rule, they will only be described once. Also, all references to direction and position, unless otherwise indicated, refer to the orientation of the stringed musical instrument acoustic weight systems illustrated in the drawings.

DETAILED DESCRIPTION OF EMBODIMENTS OF THE INVENTION

An illustrative embodiment of a stringed musical instrument with an acoustic weight system is seen generally at 100 in FIG. 1. As illustrated in this figure, the stringed musical instrument 100 generally comprises a musical instrument body 104 with a soundboard or top plate 116, a curved sidewall 122 extending about a periphery of the soundboard 116, and a back wall or back plate 120, the soundboard 116 and the back plate 120 being connected to the curved sidewall 122; a neck 106 having a first end portion **106*a* and a second end portion 106*b*, the second end portion 106*b* of the neck 106 being coupled to the musical instrument body 104; a plurality of strings 102 extending from the first end portion 106*a* of the neck 106 to the soundboard or top wall 116 of the musical instrument body 104; and an acoustic weight system including a plurality of acoustic braces, tone bars, or ribs 10, 12, 14, 16, 18 attached to the back plate 120 and the curved sidewall 122 of the musical instrument body 104, respectively. Each of the plurality of acoustic braces, tone bars, or ribs 10, 12, 14, 16 is spaced apart along an interior surface of the back plate 120, while each of the plurality of acoustic side braces 18 is spaced apart along an interior surface of the curved sidewall 122. As shown in FIG. 1, the acoustic weight system further includes a plurality of weights 20 coupled to the plurality of acoustic braces, tone bars, or ribs 10, 12, 14, 16, 18 by threaded fasteners 22. The acoustic weight system is configured to change a resonant frequency of the back plate 120 and/or the curved sidewall 122 of the musical instrument body 104 in order to modify a sound and/or tone of the stringed musical instrument 100. For example, weights 20 may be selectively added and/or removed to the acoustic braces, tone bars, or ribs 10, 12, 14, 16, 18 so as to increase and decrease the resonant frequency of the back plate 120 and/or the curved sidewall 122 of the musical instrument body 104**.

Referring again to FIG. 1, it can be seen that the neck 106 of the stringed musical instrument 100 comprises a fretboard 108 with a plurality of frets 110 spaced apart along the length thereof. In their relaxed state, the strings 102 of the musical instrument 100 are disposed slightly above the upper surface of the fretboard 108. A headstock 112 is located at the first end portion **106*a* of the neck 106. As shown in FIG. 1, the headstock 112 comprises a plurality of tuning pegs 114 that enable the tension of the strings 102 to be adjusted, which in turn, alters the pitch of the strings 102. The headstock 112 also may comprise an overlay disposed on the top surface thereof. In FIG. 1, it can be seen that one end of each string 102 of the musical instrument 100 is fixedly attached to the instrument body 104 at a bridge 124, while the other, opposite end of each string 102 is adjustably attached to a respective tuning peg 114 of the headstock 112. Each string 102 also passes over a saddle member 126 before terminating into the bridge 124. The vibration of each string 102 is transmitted through the bridge 124 and saddle 126 to the instrument body 104 by virtue of the soundboard 116**.

Also as illustrated in FIG. 1, the instrument body 104 comprises a sidewall frame structure that includes a top peripheral brace member 128, a bottom peripheral brace member 130, and a plurality of side brace members 18 that are attached to, and extend between the top and bottom peripheral brace members 128, 130. In FIG. 1, it can be seen that the side brace members 18 are disposed perpendicular to, or generally perpendicular to the top and bottom peripheral brace members 128, 130. The curved sidewall 122 of the musical instrument body 104 is mounted on, and supported by the body frame structure 18, 128, 130 of the stringed musical instrument 100. The back plate 120 is attached to the bottom of the body frame structure 18, 128, 130, while the top plate or soundboard 116 of the instrument 100 is attached to the top of the body frame structure 18, 128, 130. With reference again to FIG. 1, it can be seen that the soundboard 116 of the instrument body 104 is provided with a generally flat top surface and a sound port 118 disposed therethrough for allowing the sounds that are amplified by the hollow body 104 to be discharged from interior of the body 104 to the ambient environment (i.e., so that the musical sounds generated by the instrument 100 can be heard by the musician and his or her audience). In an alternative embodiment, the soundboard 116 of the instrument body 104 may be provided with an arched top, rather than the generally flat top surface shown in FIG. 1.

Figure 2:
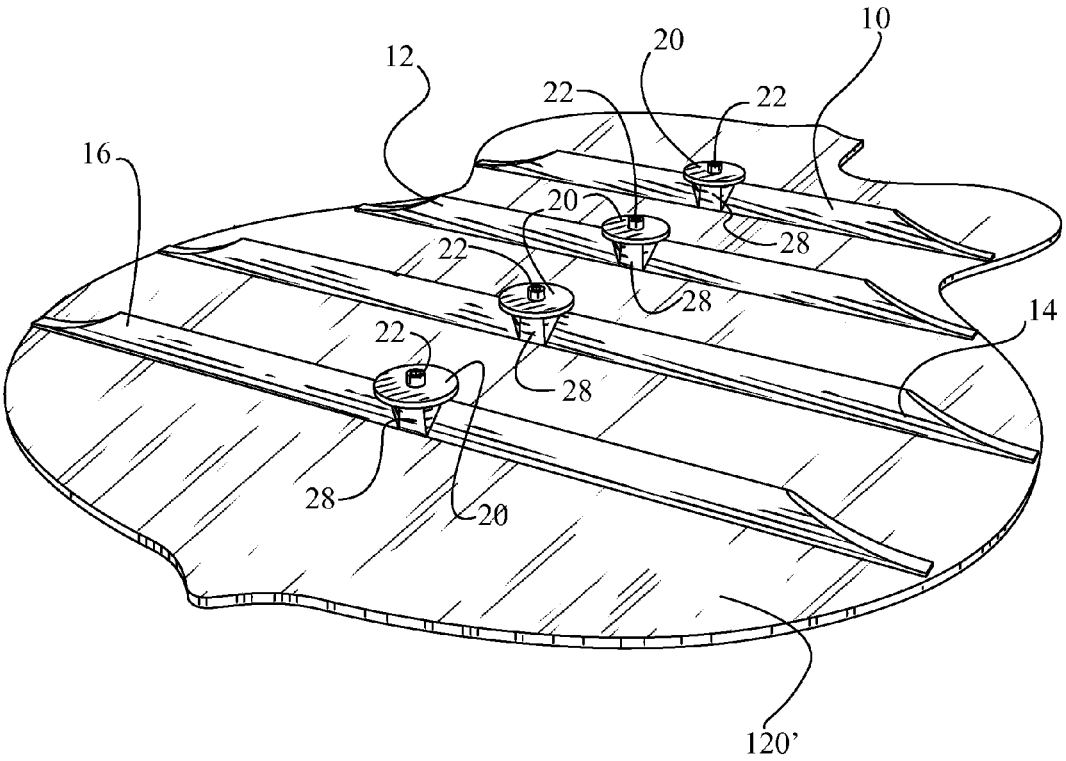
FIG. 2 is a perspective view of a plate of a stringed musical instrument body with an acoustic weight system provided thereon, according to an embodiment of the invention.

Next, referring to FIG. 2, an illustrative embodiment of an instrument plate 120' that includes an acoustic weight system will be described. As shown in this figure, the acoustic weight system of FIG. 2 comprises a plurality of acoustic braces and/or tone bars 10, 12, 14, 16 that are spaced apart along the length of a plate 120' of a musical instrument body. While the illustrated plate 120' of FIG. 2 is similar to the back plate 120 of the instrument 100 depicted in FIG. 1, it is to be understood that the acoustic weight system of FIG. 2 may be equally applied to the top plate or soundboard 116 of the instrument 100 of FIG. 1. The acoustic weight system of FIG. 2 is configured to change a resonant frequency of the plate 120' in order to modify a sound and/or tone of a stringed musical instrument. In FIG. 2, it can be seen that the first acoustic brace and/or tone bar 10 has a first length, the second acoustic brace and/or tone bar 12 has a second length that is greater than the first length, the third acoustic brace and/or tone bar 14 has a third length that is greater than the first and second lengths, and the fourth acoustic brace and/or tone bar 16 has a fourth length that is slightly less than the third length of the third acoustic brace and/or tone bar 14. As shown in FIG. 2, each acoustic brace and/or tone bar 10, 12, 14, 16 has a weight support portion 28 disposed in the approximate center thereof. The weight support portion 28 of each acoustic brace and/or tone bar 10, 12, 14, 16 has a disk-shaped weight 20 attached thereto by means of a threaded fastener 22. The details of the weight support portion 28 and manner in which the weight 20 is attached thereto will be described in the illustrative embodiments discussed hereinafter.

Figure 3:
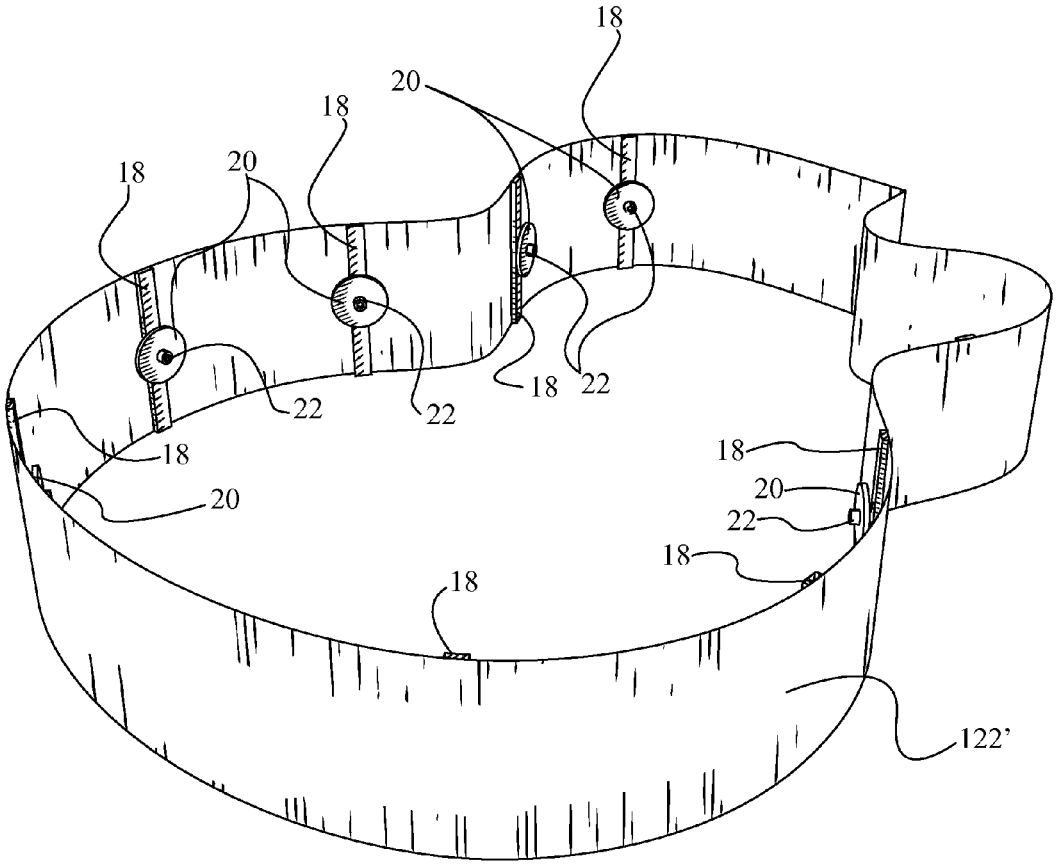
FIG. 3 is a perspective view of a curved sidewall of a stringed musical instrument body with an acoustic weight system provided thereon, according to an embodiment of the invention.

Now, turning to FIG. 3, an illustrative embodiment of an instrument curved sidewall 122' that includes an acoustic weight system will be described. As shown in this figure, the acoustic weight system of FIG. 3 comprises a plurality of side braces 18 that are spaced apart along the interior surface of the curved sidewall 122' of a musical instrument body. The illustrated curved sidewall 122' of FIG. 3 is similar to the curved sidewall 122 of the instrument 100 depicted in FIG. 1. The acoustic weight system of FIG. 3 is configured to change a resonant frequency of the curved sidewall 122' in order to modify a sound and/or tone of a stringed musical instrument. In FIG. 3, it can be seen that each of the side braces 18 has generally the same length, which is approximately equal to the height of the curved sidewall 122'. As shown in FIG. 3, each side brace 18 has a disk-shaped weight 20 disposed in the approximate center thereof. Each disk-shaped weight 20 is attached to its respective side brace 18 by means of a threaded fastener 22. Further details of the manner in which the weight 20 may be attached to the braces 18 will be described in the illustrative embodiments discussed hereinafter.

Figure 4:
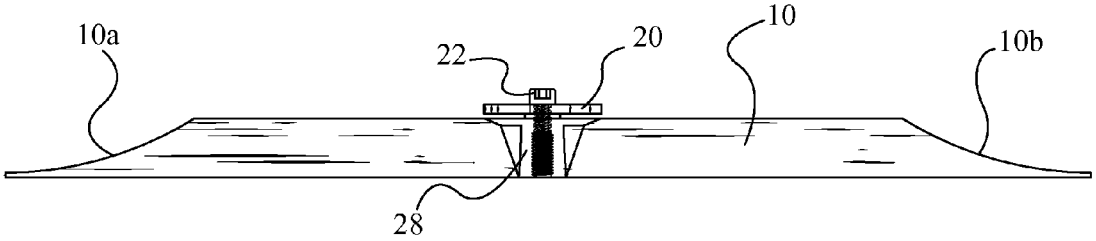
FIG. 4 is a side view of an acoustic brace and/or tone bar with a single disk-shaped weight attached thereto by means of a first type of threaded fastener, according to one embodiment of the invention.
Figure 5:
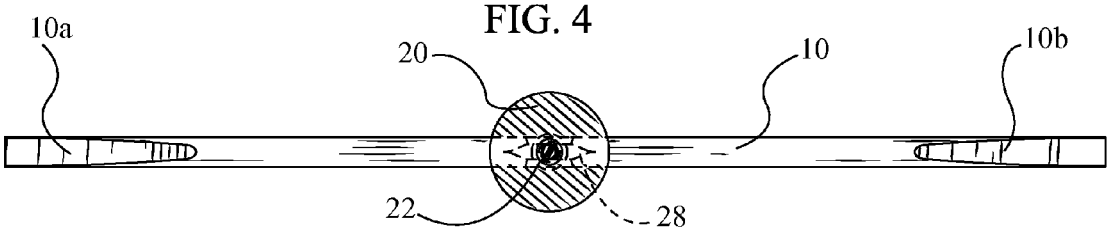
FIG. 5 is a top view of the acoustic brace and/or tone bar with the single disk-shaped weight of FIG. 4.
Figure 6:
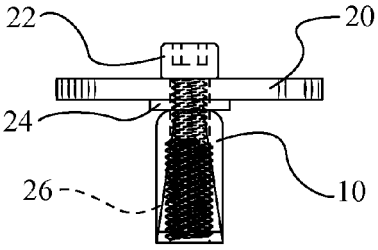
FIG. 6 is an end view of the acoustic brace and/or tone bar with the single disk-shaped weight of FIG. 4.
Figure 7:
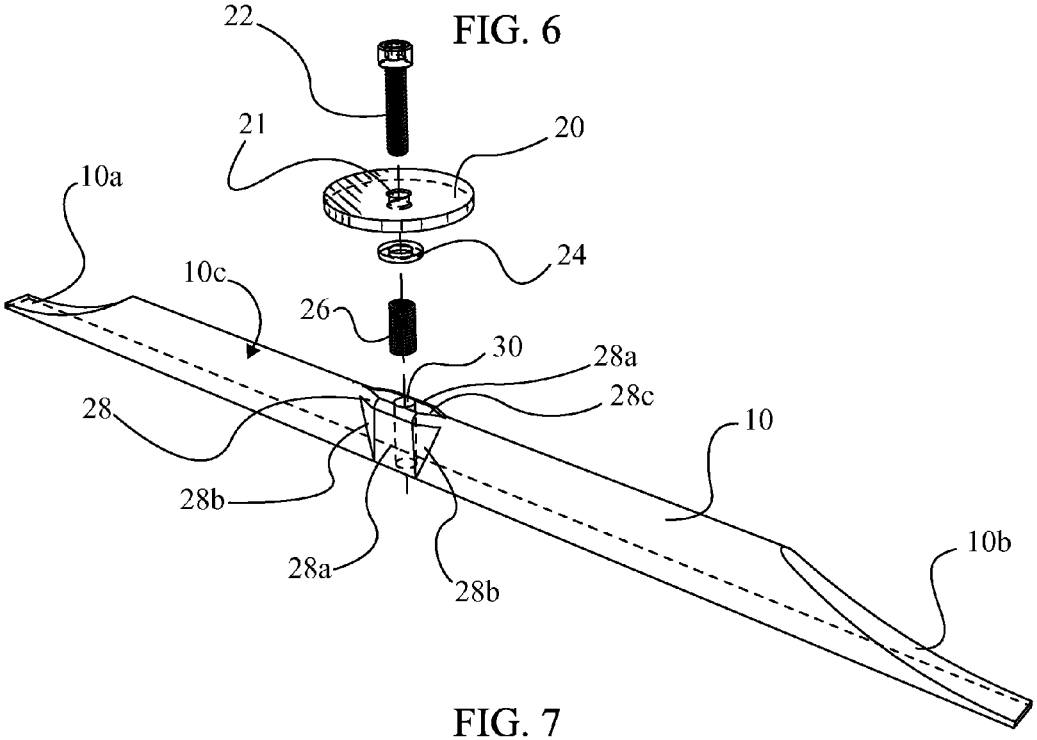
FIG. 7 is an exploded perspective view of the acoustic brace and/or tone bar with the single disk-shaped weight of FIG. 4.
Figure 8:
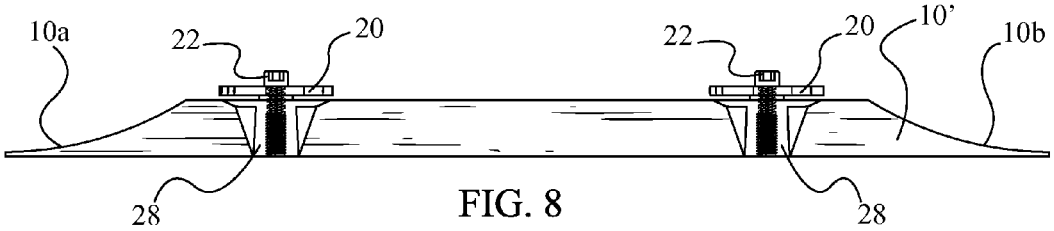
FIG. 8 is a side view of an acoustic brace and/or tone bar with two spaced-apart disk-shaped weights attached thereto by means of threaded fasteners, according to another embodiment of the invention.
Figure 9:
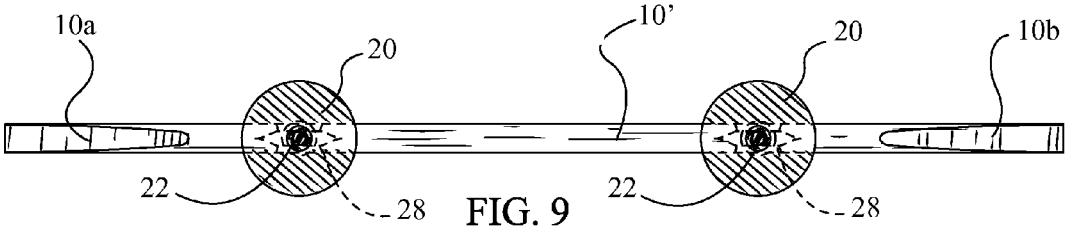
FIG. 9 is a top view of the acoustic brace and/or tone bar with the two spaced-apart disk-shaped weights of FIG. 8.
Figure 10:
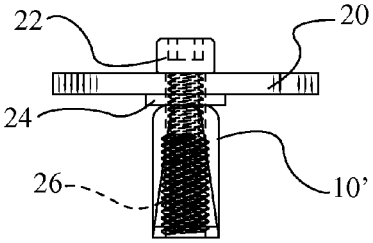
FIG. 10 is an end view of the acoustic brace and/or tone bar with the two spaced-apart disk-shaped weights of FIG. 8.
Figure 11:
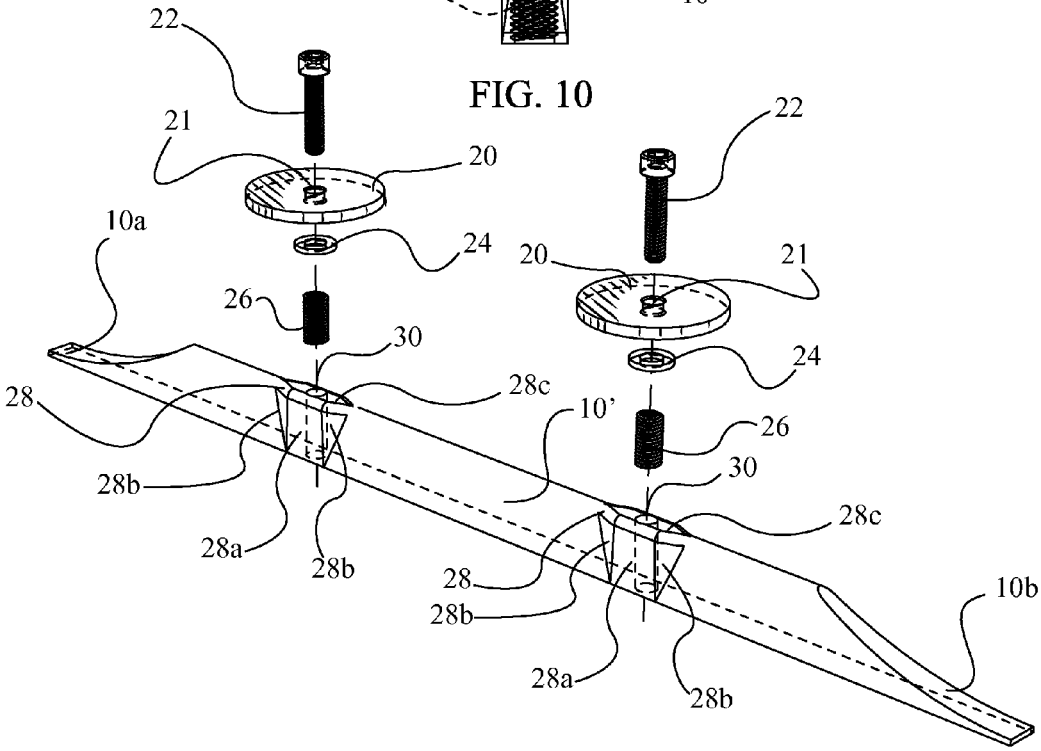
FIG. 11 is an exploded perspective view of the acoustic brace and/or tone bar with the two spaced-apart disk-shaped weights of FIG. 8.
Figure 12:
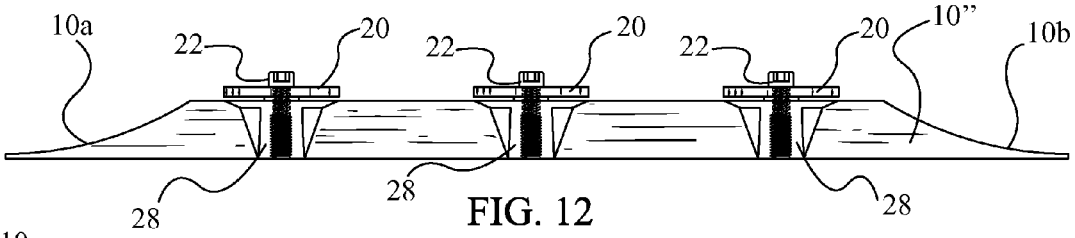
FIG. 12 is a side view of an acoustic brace and/or tone bar with three spaced-apart disk-shaped weights attached thereto by means of threaded fasteners, according to yet another embodiment of the invention.
Figure 13:
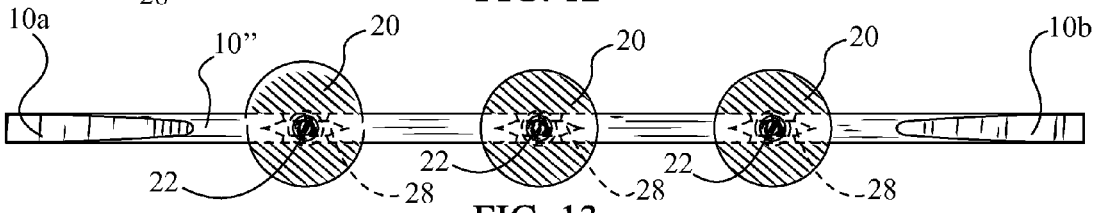
FIG. 13 is a top view of the acoustic brace and/or tone bar with the three spaced-apart disk-shaped weights of FIG. 12.
Figure 14:
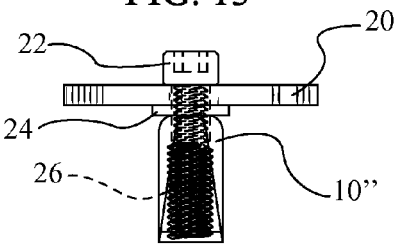
FIG. 14 is an end view of the acoustic brace and/or tone bar with the three spaced-apart disk-shaped weights of FIG. 12.
Figure 15:
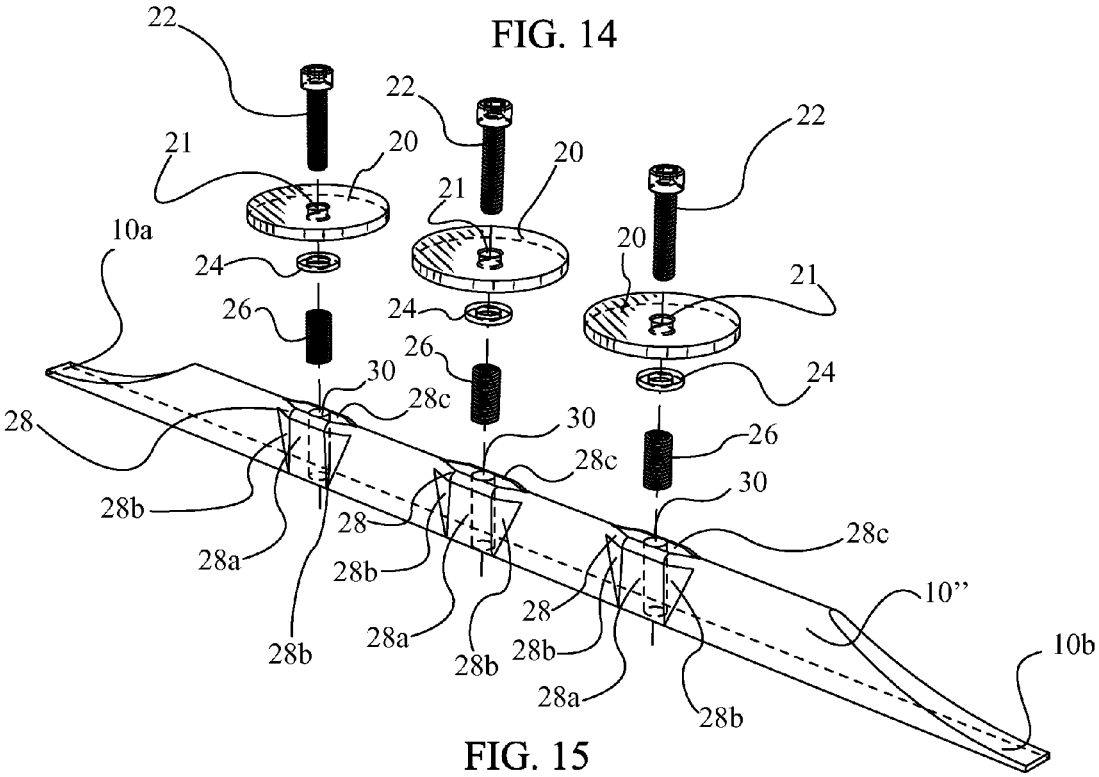
FIG. 15 is an exploded perspective view of the acoustic brace and/or tone bar with the three spaced-apart disk-shaped weights of FIG. 12.

With reference to FIGS. 4-7, a first illustrative embodiment of an acoustic weight system for a stringed musical instrument will be described. As shown in these figures, the acoustic weight system generally comprises an acoustic brace and/or tone bar 10 that is configured to be attached to one or more walls of a musical instrument body, and a single disk-shaped weight 20 that is connected to the top surface of the acoustic brace and/or tone bar 10 by a first type of threaded fastener 22 (i.e., a bolt or machine screw 22). As described above, the acoustic weight system is configured to change a resonant frequency of the one or more walls of the musical instrument body in order to modify a sound and/or tone of a stringed musical instrument. Referring to FIGS. 4, 5, and 7, it can be seen that the acoustic brace and/or tone bar 10 has a tapered first end portion 10*a* at a first longitudinal end thereof, a tapered second end portion 10*b* at a second longitudinal end thereof, a first base surface at the bottom thereof, and a curved, second upper surface 10*c* disposed opposite to the first base surface, and disposed between the tapered first and second end portions 10*a*, 10*b*. Also, as shown in FIGS. 4, 5, and 7, the acoustic brace and/or tone bar 10 has a thickness defined by a distance between the first base surface and the curved, second upper surface 10*c*. Each tapered end portion 10*a*, 10*b* has a semi-circular upper surface that slopes upwardly from an outermost end of the acoustic brace and/or tone bar 10 to its curved upper surface 10*c*. Also, as best shown in the perspective view of FIG. 7, the acoustic brace and/or tone bar 10 includes a weight support portion 28 disposed in the approximate longitudinal center thereof (i.e., the weight support portion 28 is approximately centered between the tapered first and second end portions 10*a*, 10*b* of the acoustic brace and/or tone bar 10). The weight support portion 28 divides the longitudinally-extending curved upper surface 10*c* of the acoustic brace and/or tone bar 10 into a first longitudinal part with first end portion 10*a* and a second longitudinal part with second end portion 10*b*. In FIG. 7, it can be seen that the weight support portion 28 includes a flat top mounting surface 28*c* for accommodating the stable mounting of the disk-shaped weight 20 and a pair of spaced-apart generally planar sidewalls 28*a* extending from the bottom base surface of the acoustic brace and/or tone bar 10 to the flat top mounting surface 28*c*. In addition, as shown in FIG. 7, each of the pair of spaced-apart generally planar sidewalls 28*a* has diagonally extending sidewalls 28*b* disposed on respective opposite sides thereof. In the illustrated embodiment, the diagonally extending sidewalls 28*b* extend outwardly from the generally planar sidewalls 28*a* of the weight support portion 28 at approximately 30 degree angles. As best illustrated in the top view of FIG. 5 and the perspective view of FIG. 7, the weight support portion 28 of the acoustic brace and/or tone bar 10 has an overall flattened hexagonal shape, wherein the generally planar sidewalls 28*a* and the diagonally extending sidewalls 28*b* form the sides of the flattened hexagon. Advantageously, the shape of the weight support portion 28 enables the disk-shaped weight 20 to be stably supported on the upper surface of the acoustic brace and/or tone bar 10 in an efficient manner without any rocking back and forth. As shown in FIGS. 1 and 2, when the acoustic braces and/or tone bars 10 are mounted to the back wall 120, 120' of the musical instrument body 104, the disk-shaped weights 20 are spaced apart from the wall 120, 120' of the musical instrument body 104 by the thicknesses of the acoustic braces and/or tone bars 10.

Now, referring again to FIGS. 4-7, the manner in which the disk-shaped weight 20 is secured to the acoustic brace and/or tone bar 10 will be explained. As shown in these figures, the disk-shaped weight 20 is secured to the weight support portion 28 of the acoustic brace and/or tone bar 10 using the threaded fastener 22 (i.e., bolt or machine screw 22). In particular, the weight support portion 28 is provided with a weight fastener aperture 30 disposed therein that receives a threaded insert member 26. In FIG. 6, it can be seen that the threaded insert member is received within the weight fastener aperture 30 of the acoustic brace and/or tone bar 10. When the disk-shaped weight 20 is being attached to the acoustic brace and/or tone bar 10, the threaded fastener 22 is inserted through the fastener aperture 21 in the approximate center of the weight 20, and then it is threadingly engaged with the threaded insert member 26. That is, the external threads of the shaft of the threaded fastener 22 correspond to the internal threads of the threaded insert member 26 such that the head of the threaded fastener 22 is capable of being tightened against the top surface of the disk-shaped weight 20. Also, as best shown in FIGS. 6 and 7, a washer 24 is sandwiched between the bottom surface of the weight 20 and the flat top mounting surface 28*c* of the weight support portion 28 to enhance the stability of the weight 20 on the top surface 28*c* of the weight support portion 28 of the acoustic brace and/or tone bar 10. As shown in FIGS. 4-7, the head of the threaded fastener 22 is provided with a recess disposed therein (e.g., a hexagonal recess for receiving a hex wrench or Allen wrench).

A second illustrative embodiment of an acoustic weight system for a stringed musical instrument is shown in FIGS. 8-11. Referring to these figures, it can be seen that, in many respects, the second illustrative embodiment is similar to that of the first illustrative embodiment. Moreover, many elements are common to both such embodiments. For the sake of brevity, the elements that the second illustrative embodiment of the acoustic weight system has in common with the first illustrative embodiment will not be discussed because these components have already been explained in detail above. Furthermore, in the interest of clarity, these elements are denoted using the same reference characters that were used in the first illustrative embodiment.

In the second illustrative embodiment, the acoustic weight system comprises two (2) disk-shaped weights 20 spaced apart along a length of the acoustic brace and/or tone bar 10', rather than just a single weight 20 disposed in the approximate center of the acoustic brace and/or tone bar 10 as depicted in the first illustrative embodiment. In particular, a first one of the weights 20 is disposed inwardly from the tapered first end portion 10*a*, and a second one of the weights is disposed inwardly from the tapered second end portion 10*b*. The longitudinal distance between the center points of the two weights 20 is approximately two times the distance from the center point of each weight 20 to its respective longitudinal end 10*a*, 10*b* of the acoustic brace and/or tone bar 10'. As most clearly illustrated in the perspective view of FIG. 11, each weight 20 is provided with a corresponding weight support portion 28 on the acoustic brace and/or tone bar 10' so that each weight 20 can be stably supported thereon. Each weight support portion 28 of the acoustic brace and/or tone bar 10' has a structure that is identical to that described above in conjunction with the first illustrative embodiment. In addition, each disk-shaped weight 20 is secured to the acoustic brace and/or tone bar 10' in the same manner that was explained above for the first illustrative embodiment (i.e., by using threaded fasteners 22 and threaded insert members 26, etc.).

A third illustrative embodiment of an acoustic weight system for a stringed musical instrument is shown in FIGS. 12-15. Referring to these figures, it can be seen that, in many respects, the third illustrative embodiment is similar to that of the first and second illustrative embodiments. Moreover, many elements are common to all of the embodiments. For the sake of brevity, the elements that the third illustrative embodiment of the acoustic weight system has in common with the first and second illustrative embodiments will not be discussed because these components have already been explained in detail above. Furthermore, in the interest of clarity, these elements are denoted using the same reference characters that were used in the first and second illustrative embodiments.

In the third illustrative embodiment, the acoustic weight system comprises three (3) disk-shaped weights 20 spaced apart along a length of the acoustic brace and/or tone bar 10", rather than the one or two weights 20 described above in conjunction with the first and second illustrative embodiments, respectively. In particular, a first one of the weights 20 is disposed inwardly from the tapered first end portion 10*a*, a second one of the weights is disposed inwardly from the tapered second end portion 10*b*, and a third one of the weights 20 is disposed between the first and second weights 20. The first and second weights 20 are each spaced apart from the centrally disposed third weight by approximately the same longitudinal distance, and each of the first and second weights 20 is spaced apart from its respective longitudinal end 10*a*, 10*b* of the acoustic brace and/or tone bar 10" by generally the same longitudinal distance. The longitudinal distance between the center points of each weight 20 is slightly larger than the longitudinal distance between the center points of the first and second weights 20 and the respective longitudinal ends 10*a*, 10*b* of the acoustic brace and/or tone bar 10". As most clearly illustrated in the perspective view of FIG. 15, similar to that described in conjunction with the first and second illustrative embodiments above, each weight 20 is provided with a corresponding weight support portion 28 on the acoustic brace and/or tone bar 10" so that each weight 20 can be stably supported thereon. Each weight support portion 28 of the acoustic brace and/or tone bar 10" has a structure that is identical to that described above in conjunction with the first and second illustrative embodiments. In addition, each disk-shaped weight 20 is secured to the acoustic brace and/or tone bar 10" in the same manner that was explained above for the first illustrative embodiment (i.e., by using threaded fasteners 22 and threaded insert members 26, etc.).

A fourth illustrative embodiment of an acoustic weight system for a stringed musical instrument is shown in FIGS. 16-19. Referring to these figures, it can be seen that, in some respects, the fourth illustrative embodiment is similar to that of the preceding illustrative embodiments. Moreover, some elements are common to all of the embodiments. For the sake of brevity, the elements that the fourth illustrative embodiment of the acoustic weight system has in common with the preceding illustrative embodiments will not be discussed because these components have already been explained in detail above. Furthermore, in the interest of clarity, these elements are denoted using the same reference characters that were used in the first, second, and third illustrative embodiments.

Figure 16:
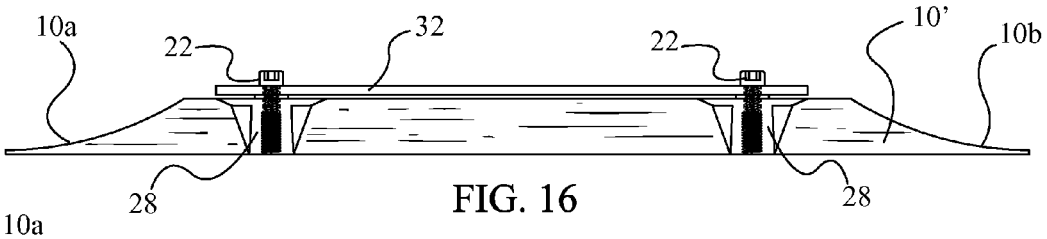
FIG. 16 is a side view of an acoustic brace and/or tone bar with a first type of rectangular bar weight attached thereto by means of threaded fasteners, according to still another embodiment of the invention.
Figure 17:
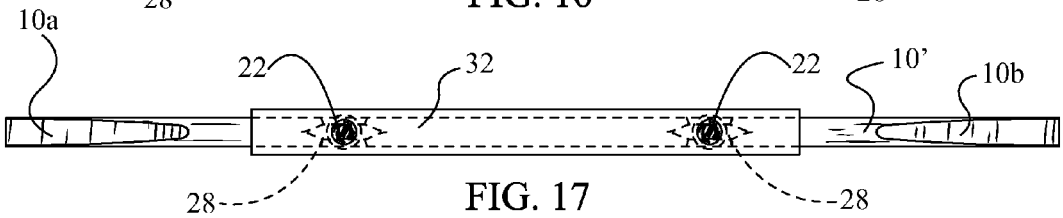
FIG. 17 is a top view of the acoustic brace and/or tone bar with the first type of rectangular bar weight of FIG. 16.
Figure 18:
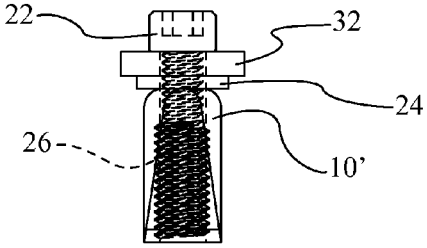
FIG. 18 is an end view of the acoustic brace and/or tone bar with the first type of rectangular bar weight of FIG. 16.
Figure 19:
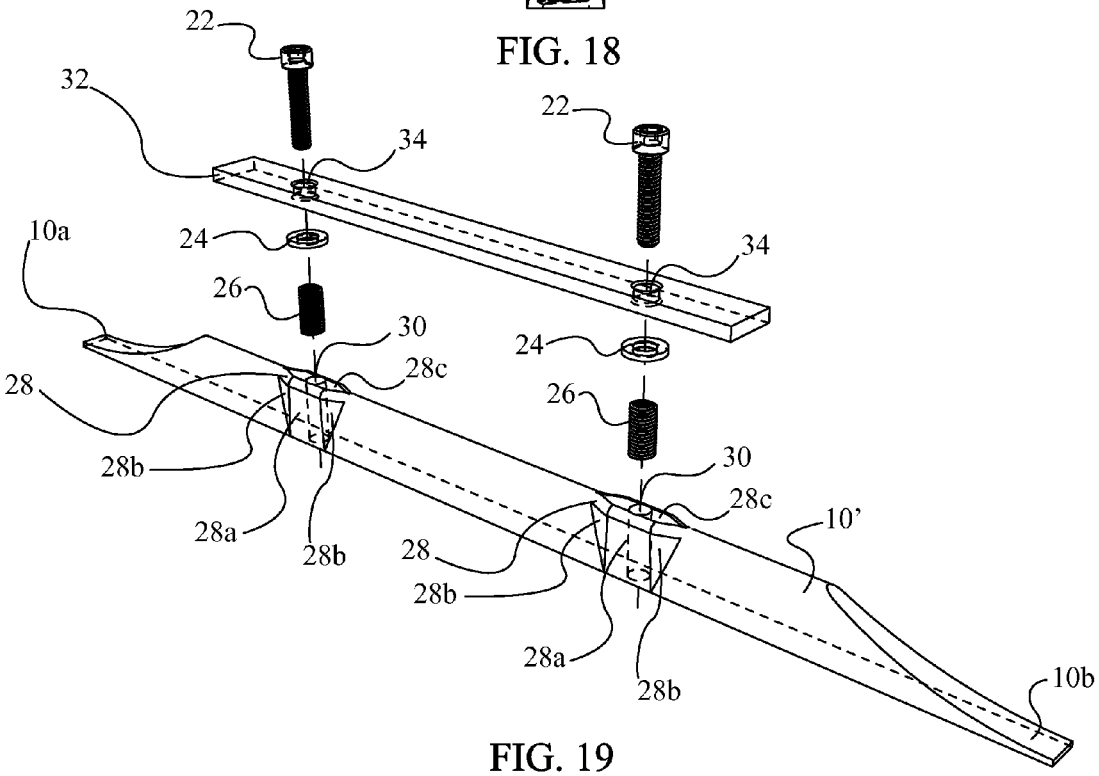
FIG. 19 is an exploded perspective view of the acoustic brace and/or tone bar with the first type of rectangular bar weight of FIG. 16.
Figure 20:
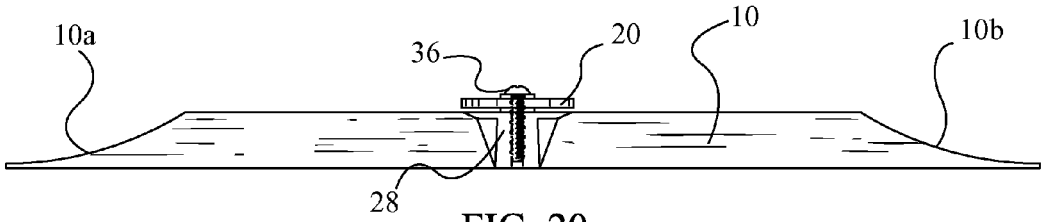
FIG. 20 is a side view of an acoustic brace and/or tone bar with a single disk-shaped weight attached thereto by means of a second type of threaded fastener, according to yet another embodiment of the invention.
Figure 21:
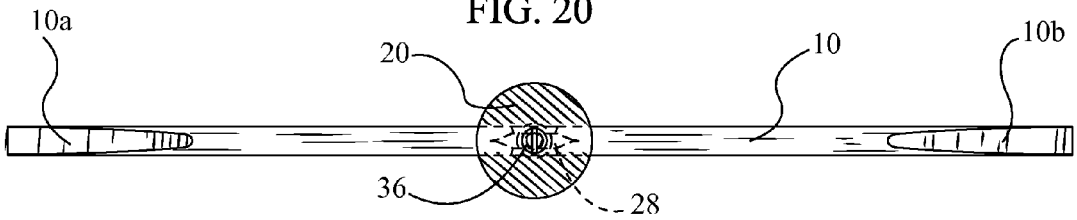
FIG. 21 is a top view of the acoustic brace and/or tone bar with the single disk-shaped weight of FIG. 20.

In the fourth illustrative embodiment, the acoustic weight system comprises a single elongated rectangular bar weight 32, rather than the one, two, or three disk-shaped weights 20 described above in conjunction with the first, second, and third illustrative embodiments, respectively. In particular, the elongated rectangular bar weight 32 is in the form of a flat rectangular prism that is supported on the curved upper surface 10*c* of the acoustic brace and/or tone bar 10' by two (2) spaced apart weight support portions 28. A first of the two (2) spaced apart weight support portions 28 is disposed proximate to a first longitudinal end of the rectangular bar weight 32, while a second of the two (2) spaced apart weight support portions 28 is disposed proximate to a second longitudinal end of the rectangular bar weight 32. Each weight support portion 28 of the acoustic brace and/or tone bar 10' has a structure that is identical to that described above in conjunction with the preceding three illustrative embodiments. In FIGS. 16 and 17, it can be seen that the elongated rectangular bar weight 32 is approximately centered between the first and second tapered end portions 10*a*, 10*b* of the acoustic brace and/or tone bar 10'. The elongated rectangular bar weight 32 is secured to the acoustic brace and/or tone bar 10' in generally the same manner that was explained above for the preceding three illustrative embodiment (i.e., by using threaded fasteners 22 and threaded insert members 26, etc.). As shown in the perspective view of FIG. 19, the elongated rectangular bar weight 32 is provided with two (2) spaced apart apertures 34 disposed therein for receiving respective ones of the threaded fasteners 22.

A fifth illustrative embodiment of an acoustic weight system for a stringed musical instrument is shown in FIGS. 20-23. Referring to these figures, it can be seen that, in many respects, the fifth illustrative embodiment is similar to that of the preceding four embodiments. Moreover, many elements are common to all of the embodiments. For the sake of brevity, the elements that the fifth illustrative embodiment of the acoustic weight system has in common with the preceding four embodiments will not be discussed because these components have already been explained in detail above. Furthermore, in the interest of clarity, these elements are denoted using the same reference characters that were used in the first, second, third, and fourth illustrative embodiments.

Figure 22:
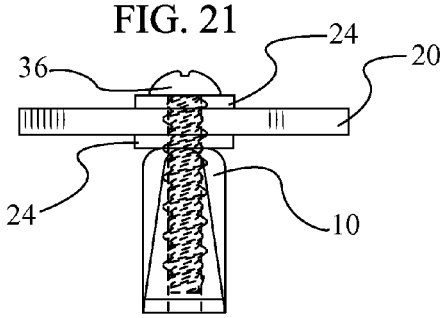
FIG. 22 is an end view of the acoustic brace and/or tone bar with the single disk-shaped weight of FIG. 20.
Figure 23:
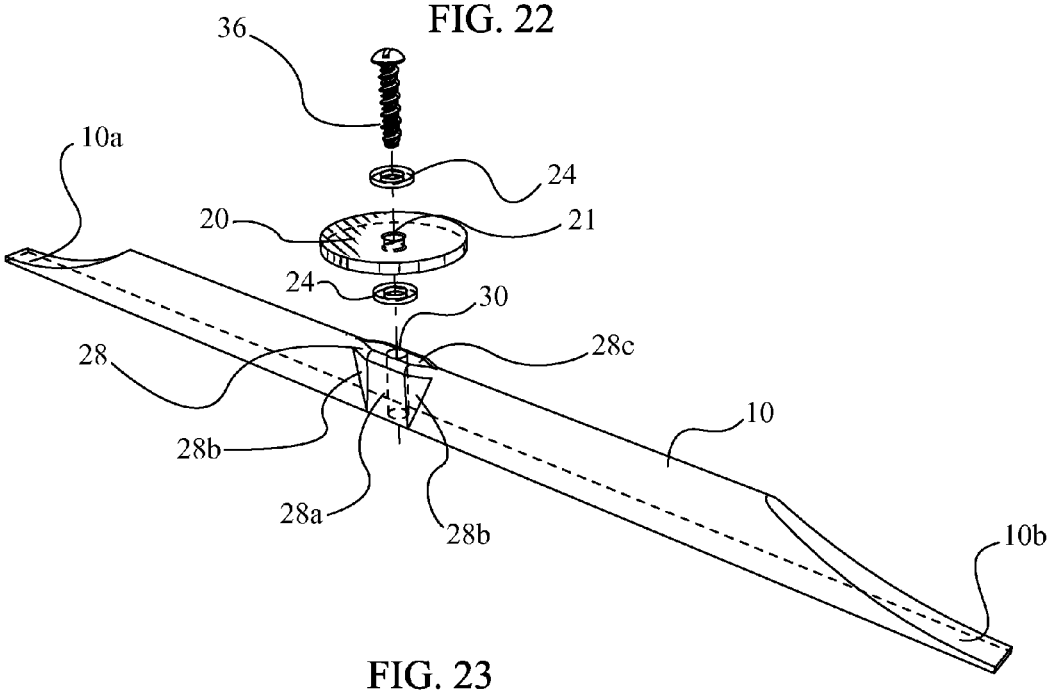
FIG. 23 is an exploded perspective view of the acoustic brace and/or tone bar with the single disk-shaped weight of FIG. 20.
Figure 24:
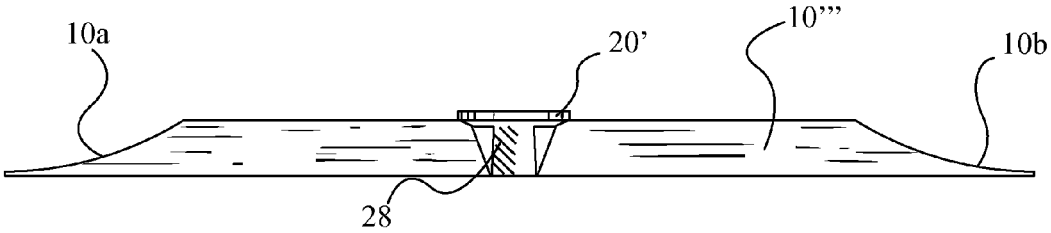
FIG. 24 is a side view of an acoustic brace and/or tone bar with a single disk-shaped weight attached thereto by means of adhesive, according to still another embodiment of the invention.
Figure 25:
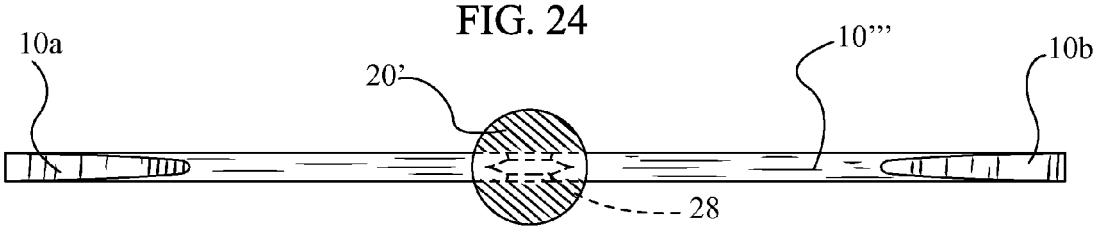
FIG. 25 is a top view of the acoustic brace and/or tone bar with the single disk-shaped weight of FIG. 24.
Figure 26:
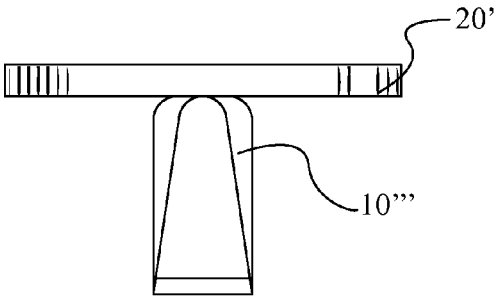
FIG. 26 is an end view of the acoustic brace and/or tone bar with the single disk-shaped weight of FIG. 24.
Figure 27:
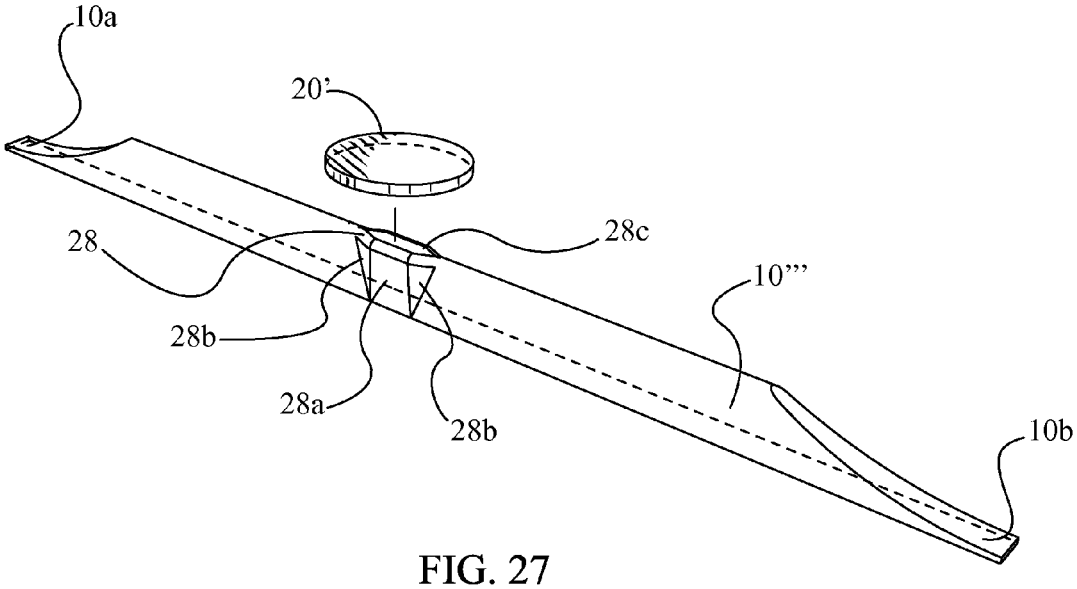
FIG. 27 is an exploded perspective view of the acoustic brace and/or tone bar with the single disk-shaped weight of FIG. 24.
Figure 28:
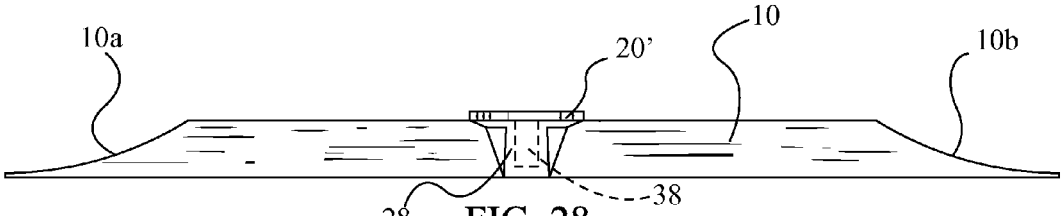
FIG. 28 is a side view of an acoustic brace and/or tone bar with a single disk-shaped weight attached thereto by means of a magnet, according to yet another embodiment of the invention.
Figure 29:
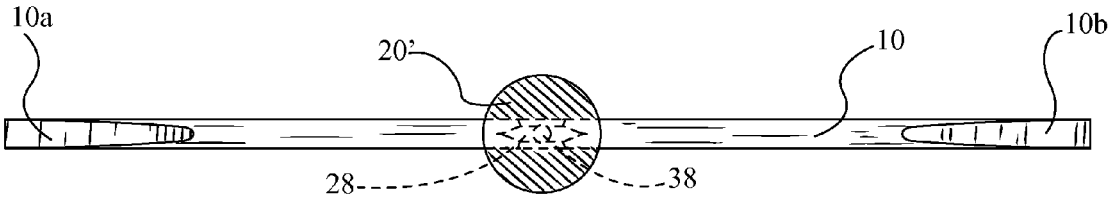
FIG. 29 is a top view of the acoustic brace and/or tone bar with the single disk-shaped weight of FIG. 28.
Figure 30:
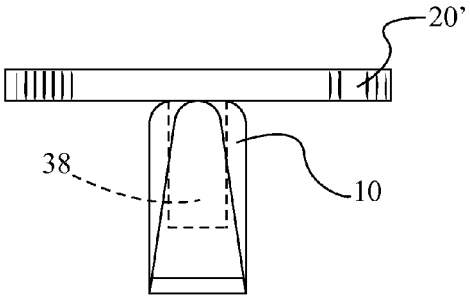
FIG. 30 is an end view of the acoustic brace and/or tone bar with the single disk-shaped weight of FIG. 28.
Figure 31:
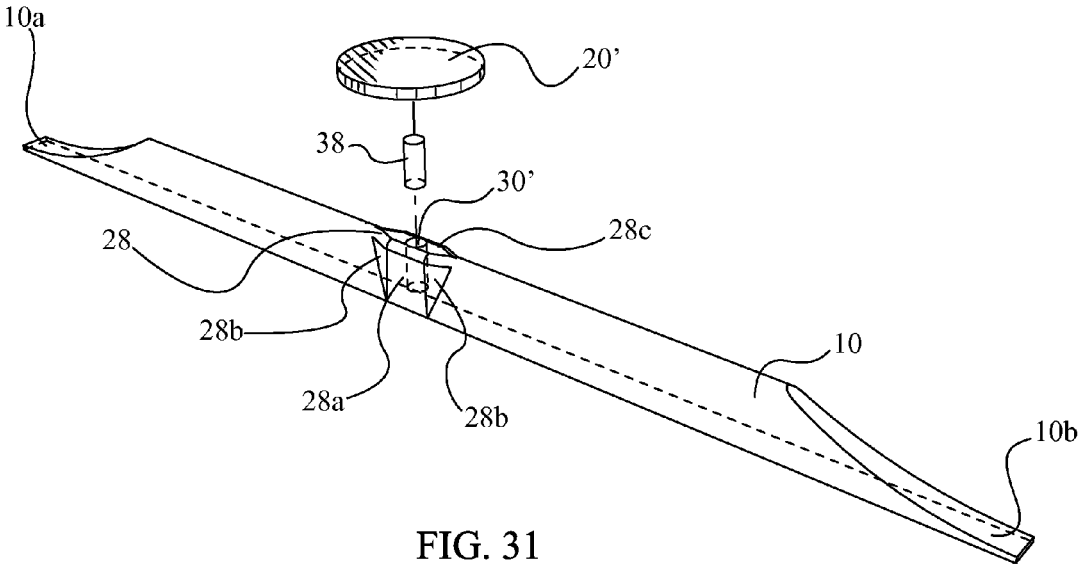
FIG. 31 is an exploded perspective view of the acoustic brace and/or tone bar with the single disk-shaped weight of FIG. 28.

In the fifth illustrative embodiment, like the first illustrative embodiment described above, the acoustic weight system comprises a single disk-shaped weight 20 disposed in the approximate center of the acoustic brace and/or tone bar 10. In particular, as in the first illustrative embodiment, the single disk-shaped weight 20 is supported on a weight support portion 28 centered between the tapered first and second end portions 10*a*, 10*b* at the oppositely disposed longitudinal ends of the acoustic brace and/or tone bar 10. The weight support portion 28 of the acoustic brace and/or tone bar 10 in FIGS. 20-23 has a structure that is identical to that described above in conjunction with the first illustrative embodiment. However, in the fifth illustrative embodiment, the disk-shaped weight 20 is secured to the acoustic brace and/or tone bar 10 in a slightly different manner than that which was explained above for the first illustrative embodiment. In particular, in the fifth illustrative embodiment, rather than using a first type of threaded fastener 22 in the form of a bolt or machine screw, the disk-shaped weight 20 is secured to the weight fastener aperture 30 in the weight support portion 28 using a second type of threaded fastener 36, namely a self-threading wood screw. Because the wood screw 36 is a self-threading type, the weight fastener aperture 30 is not provided with the threaded insert member 26 described above in conjunction with the preceding embodiments. When the disk-shaped weight 20 is being attached to the acoustic brace and/or tone bar 10 in the fifth illustrative embodiment, the self-threading wood screw 36 is inserted through the fastener aperture 21 in the approximate center of the weight 20, and then it is threadingly engaged with the cylindrical wall surrounding the weight fastener aperture 30 in the weight support portion 28. Also, as best shown in FIGS. 22 and 23, a first washer 24 is sandwiched between the bottom surface of the head of the wood screw 36 and the top surface of the weight 20, while a second washer 24 is sandwiched between the bottom surface of the weight 20 and the flat top mounting surface 28*c* of the weight support portion 28 to enhance the stability of the weight 20 on the weight support portion 28 of the acoustic brace and/or tone bar 10. As shown in FIGS. 20-23, the head of the self-threading wood screw 36 is provided with a rectilinear recess disposed therein (e.g., to receive a flat-head screwdriver).

A sixth illustrative embodiment of an acoustic weight system for a stringed musical instrument is shown in FIGS. 24-27. Referring to these figures, it can be seen that, in many respects, the sixth illustrative embodiment is similar to that of the preceding five embodiments. Moreover, many elements are common to all of the embodiments. For the sake of brevity, the elements that the sixth illustrative embodiment of the acoustic weight system has in common with the preceding five embodiments will not be discussed because these components have already been explained in detail above. Furthermore, in the interest of clarity, these elements are denoted using the same reference characters that were used in the first, second, third, fourth, and fifth illustrative embodiments.

In the sixth illustrative embodiment, like the first and fifth illustrative embodiments described above, the acoustic weight system comprises a single disk-shaped weight 20' disposed in the approximate center of the acoustic brace and/or tone bar 10'''. In particular, as in the first and fifth illustrative embodiments, the single disk-shaped weight 20' is supported on a weight support portion 28 centered between the tapered first and second end portions 10*a*, 10*b* at the oppositely disposed longitudinal ends of the acoustic brace and/or tone bar 10''. The weight support portion 28 of the acoustic brace and/or tone bar 10''' in FIGS. 24-27 has a structure that is identical to that described above in conjunction with the first and fifth illustrative embodiments, except for not containing a weight fastener aperture 30. However, in the fifth illustrative embodiment, the disk-shaped weight 20' is secured to the acoustic brace and/or tone bar 10''' in a different manner than that which was explained above for the first and fifth illustrative embodiments. In particular, in the sixth illustrative embodiment, rather than using a threaded fastener in the form of a bolt or machine screw 22 or self-threading wood screw 36, the disk-shaped weight 20' is secured to the flat top mounting surface 28*c* of the weight support portion 28 using a suitable adhesive (i.e., the bottom surface of the disk-shaped weight 20' is glued to the flat top mounting surface 28*c* of the weight support portion 28 using an adhesive or glue that is capable of bonding to both the metal weight 20' and the wood acoustic brace and/or tone bar 10'''). Because a threaded fastener is not used in the sixth illustrative embodiment for securing the disk-shaped weight 20' to the weight support portion 28 of the acoustic brace and/or tone bar 10''', the disk-shaped weight 20' of FIGS. 24-27 does not comprise the fastener aperture 21 disposed therethrough.

A seventh illustrative embodiment of an acoustic weight system for a stringed musical instrument is shown in FIGS. 28-31. Referring to these figures, it can be seen that, in many respects, the seventh illustrative embodiment is similar to that of the preceding six embodiments. Moreover, many elements are common to all of the embodiments. For the sake of brevity, the elements that the seventh illustrative embodiment of the acoustic weight system has in common with the preceding six embodiments will not be discussed because these components have already been explained in detail above. Furthermore, in the interest of clarity, these elements are denoted using the same reference characters that were used in the first, second, third, fourth, fifth, and sixth illustrative embodiments.

In the seventh illustrative embodiment, like the first, fifth, and sixth illustrative embodiments described above, the acoustic weight system comprises a single disk-shaped weight 20' disposed in the approximate center of the acoustic brace and/or tone bar 10. In particular, as in the first, fifth, and sixth illustrative embodiments, the single disk-shaped weight 20' is supported on a weight support portion 28 centered between the tapered first and second end portions 10*a*, 10*b* at the oppositely disposed longitudinal ends of the acoustic brace and/or tone bar 10. The weight support portion 28 of the acoustic brace and/or tone bar 10 in FIGS. 28-31 has a structure that is nearly identical to that described above in conjunction with the first and fifth illustrative embodiments, except that rather than comprising a weight fastener aperture 30, the weight support portion 28 has a cylindrical recess 30' disposed in the flat top mounting surface 28*c* thereof for receiving a small cylindrical magnet 38. In the seventh illustrative embodiment, the disk-shaped weight 20' is secured to the acoustic brace and/or tone bar 10 by means of the cylindrical magnet 38. In particular, the cylindrical magnet 38 is inserted and secured into the cylindrical recess 30' of the weight support portion 28, and a magnetic attraction force is exerted on the disk-shaped weight 20' by the cylindrical magnet 38 so as to retain the disk-shaped weight 20' in place on the acoustic brace and/or tone bar 10. When disposed within the cylindrical recess 30' of the weight support portion 28, the longitudinal axis of the cylindrical magnet 38 is disposed generally perpendicular to the flat bottom surface of the acoustic brace and/or tone bar 10 and the flat top mounting surface 28*c* of the weight support portion 28. Advantageously, the use of the cylindrical magnet 38 to retain the disk-shaped weight 20' on the acoustic brace and/or tone bar 10 enables the weight 20' to be easily added and removed as desired by a user (e.g., so as to modify the resonant frequency of the instrument component to which it is attached). Because a threaded fastener is not used in the seventh illustrative embodiment for securing the disk-shaped weight 20' to the weight support portion 28 of the acoustic brace and/or tone bar 10, the disk-shaped weight 20' of FIGS. 28-31, like the disk-shaped weight 20' of FIGS. 24-27, does not comprise the fastener aperture 21 disposed therethrough.

An eighth illustrative embodiment of an acoustic weight system for a stringed musical instrument is shown in FIGS. 32-35. Referring to these figures, it can be seen that, in some respects, the eighth illustrative embodiment is similar to that of the preceding illustrative embodiments. Moreover, some elements are common to all of the embodiments. For the sake of brevity, the elements that the eighth illustrative embodiment of the acoustic weight system has in common with the preceding illustrative embodiments will not be discussed because these components have already been explained in detail above. Furthermore, in the interest of clarity, these elements are denoted using the same reference characters that were used in the first through the seventh illustrative embodiments.

Figure 32:
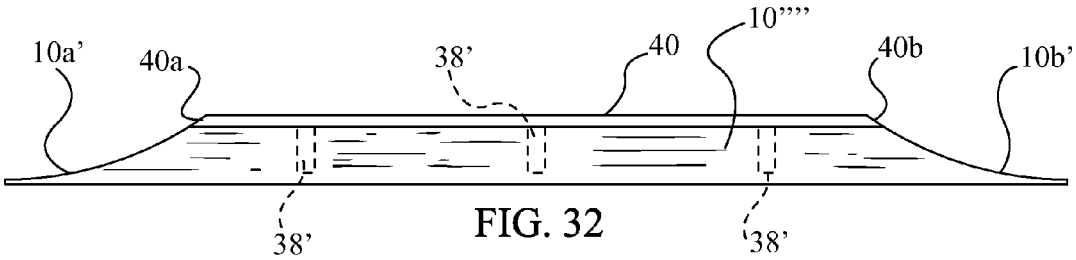
FIG. 32 is a side view of an acoustic brace and/or tone bar with a second type of rectangular bar weight attached thereto by means of a plurality of magnets, according to still another embodiment of the invention.
Figure 33:
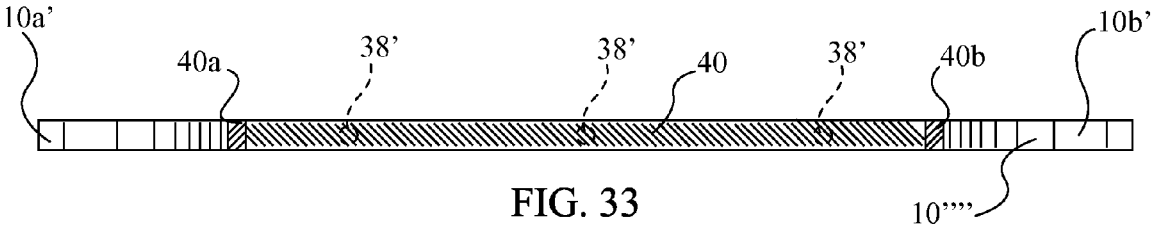
FIG. 33 is a top view of the acoustic brace and/or tone bar with the second type of rectangular bar weight of FIG. 32.
Figure 34:
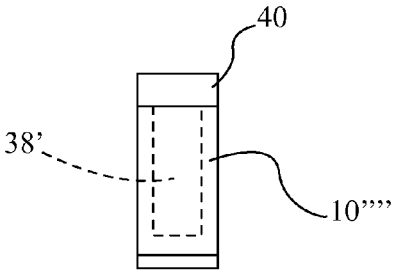
FIG. 34 is an end view of the acoustic brace and/or tone bar with the second type of rectangular bar weight of FIG. 32.
Figure 35:
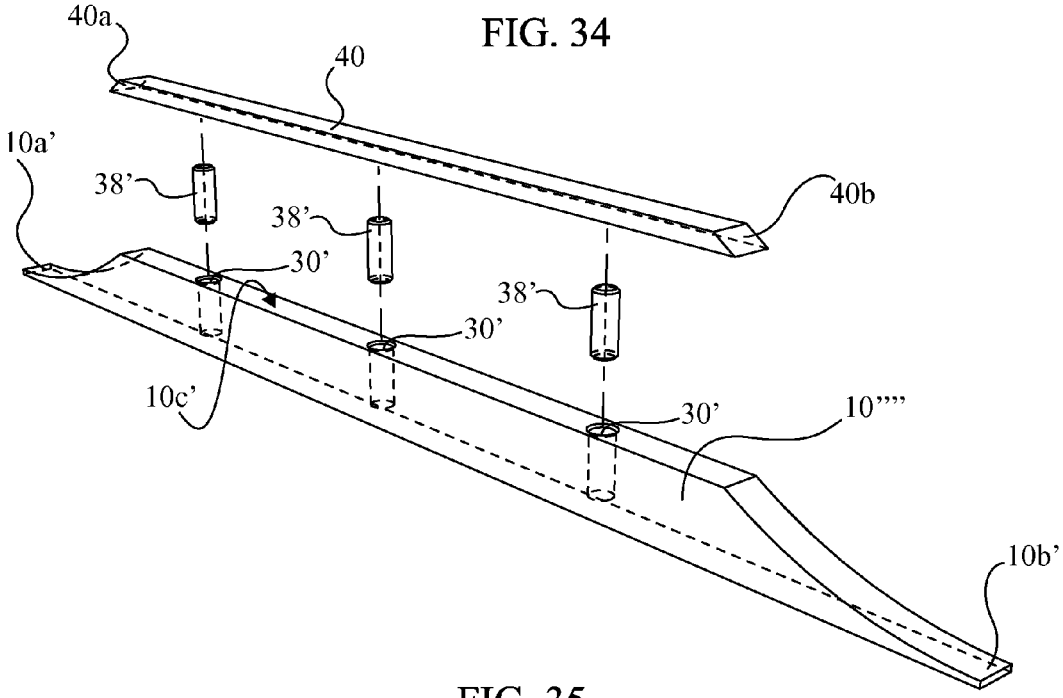
FIG. 35 is an exploded perspective view of the acoustic brace and/or tone bar with the second type of rectangular bar weight of FIG. 32.

In the eighth illustrative embodiment, similar to the fourth illustrative embodiment, the acoustic weight system comprises a single elongated rectangular bar weight 40, rather than the one or more disk-shaped weights 20. In particular, the elongated rectangular bar weight 40 is in the form of a flat rectangular prism with tapered first and second ends 40*a*, 40*b* that generally conform to the slopes of the first and second end portions 10*a*', 10*b*' of the acoustic brace and/or tone bar 10'''' (refer to FIG. 32). The taper-ended rectangular bar weight 40 is supported on a flat top surface 10*c*' of the acoustic brace and/or tone bar 10'''' (see FIG. 35). As such, unlike the preceding embodiments, the acoustic brace and/or tone bar 10'''' of the eighth illustrative embodiment does not comprise any weight support portions 28. In FIGS. 32 and 33, it can be seen that the tapered ends 40*a*, 40*b* of the elongated rectangular bar weight 40 are generally aligned with the sloped upper surfaces of the first and second end portions 10*a*', 10*b*'. The elongated rectangular bar weight 40 is secured to the acoustic brace and/or tone bar 10'''' in a similar manner that was explained above for the preceding seventh illustrative embodiment (i.e., by using a plurality of cylindrical magnets 38'). In particular, as shown in the perspective view of FIG. 35, the elongated rectangular bar weight 40 is secured to the flat top surface 10*c*' of the acoustic brace and/or tone bar 10'''' by means of three (3) spaced-apart cylindrical magnets 38'. Similar to that described above for the seventh illustrative embodiment, each of the three cylindrical magnets 38' is inserted into a respective cylindrical recess 30' of the acoustic brace and/or tone bar 10''''. A magnetic attraction force is exerted on the elongated rectangular bar weight 40 by each of the cylindrical magnets 38' so as to retain the rectangular bar weight 40 in place on the acoustic brace and/or tone bar 10''''. When disposed within their cylindrical recesses 30' in the acoustic brace and/or tone bar 10'''', the longitudinal axes of the cylindrical magnets 38' are each disposed generally perpendicular to the flat bottom surface and the flat top surface 10*c*' of the acoustic brace and/or tone bar 10''''. Advantageously, the use of the cylindrical magnets 38' to retain the elongated rectangular bar weight 40 on the acoustic brace and/or tone bar 10'''' enables the weight 40 to be easily added and removed as desired by a user (e.g., so as to modify the resonant frequency of the instrument component to which it is attached). Because threaded fasteners are not used in the eighth illustrative embodiment for securing the elongated rectangular bar weight 40 to the acoustic brace and/or tone bar 10'''', the elongated rectangular bar weight 40, unlike the elongated rectangular bar weight 32 of the fourth illustrative embodiment, does not comprise the fastener apertures disposed therethrough.

A ninth illustrative embodiment of an acoustic weight system for a stringed musical instrument is shown in FIGS. 36-39. Referring to these figures, it can be seen that, in some respects, the ninth illustrative embodiment is similar to that of the preceding illustrative embodiments. Moreover, some elements are common to all of the embodiments. For the sake of brevity, the elements that the ninth illustrative embodiment of the acoustic weight system has in common with the preceding illustrative embodiments will not be discussed because these components have already been explained in detail above. Furthermore, in the interest of clarity, these elements are denoted using the same reference characters that were used in the first through the eighth illustrative embodiments.

Figure 36:
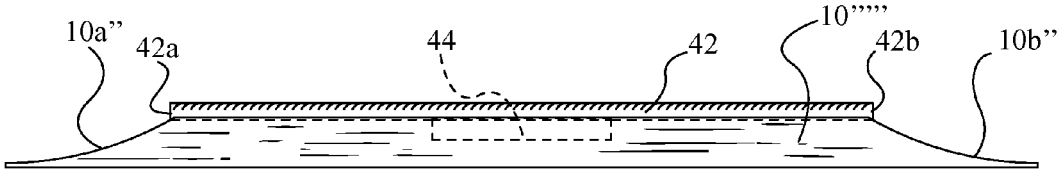
FIG. 36 is a side view of an acoustic brace and/or tone bar with an elongated cylindrical weight attached thereto by means of an elongated magnet, according to yet another embodiment of the invention.
Figure 37:
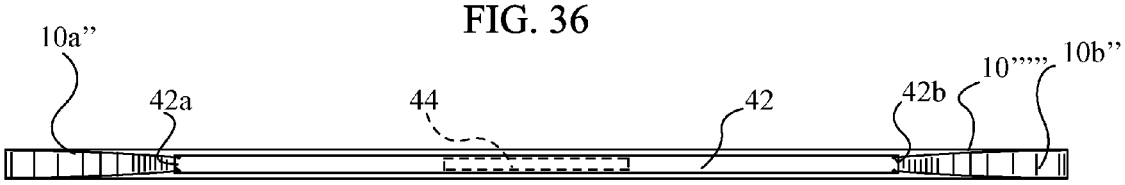
FIG. 37 is a top view of the acoustic brace and/or tone bar with the elongated cylindrical weight of FIG. 36.
Figure 38:
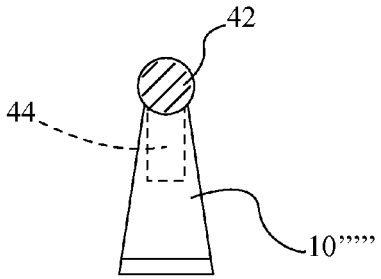
FIG. 38 is an end view of the acoustic brace and/or tone bar with the elongated cylindrical weight of FIG. 36.
Figure 39:
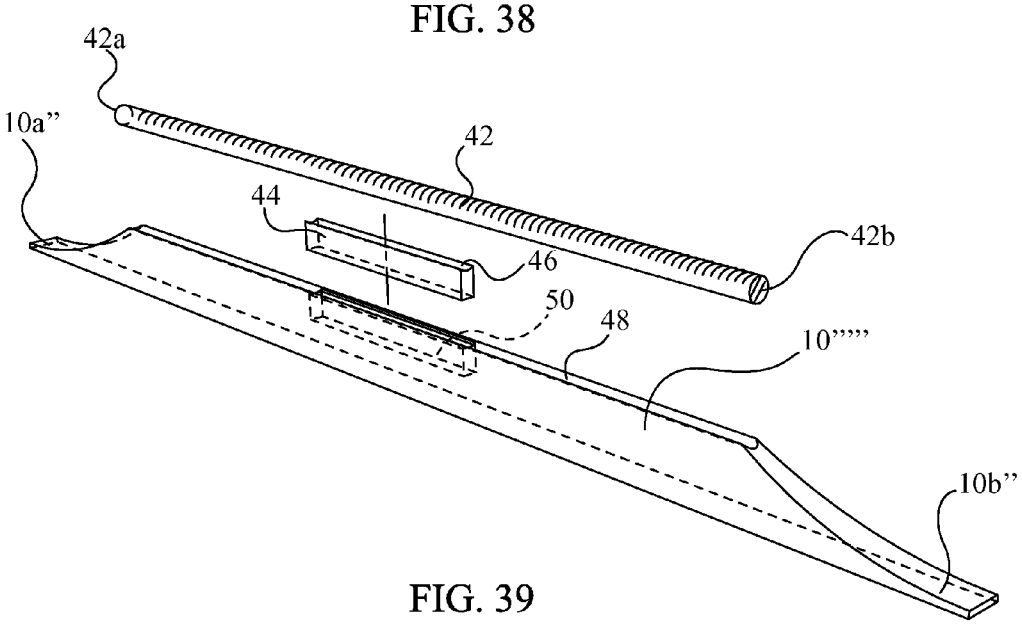
FIG. 39 is an exploded perspective view of the acoustic brace and/or tone bar with the elongated cylindrical weight of FIG. 36.

In the ninth illustrative embodiment, the acoustic weight system comprises a single elongated cylindrical weight 42 attached to an acoustic brace and/or tone bar 10'''''. In particular, the elongated cylindrical weight 42 is in the form of a cylindrical rod with first and second flat ends 42*a*, 42*b* (refer to FIGS. 36 and 39). As best shown in the exploded perspective view of FIG. 39, the elongated cylindrical weight 42 is supported in a concave groove 48 on the top surface of the acoustic brace and/or tone bar 10'''''. The circular curvature of the concave groove 48 cross-section substantially corresponds to the curvature of the outer circular wall of the elongated cylindrical weight 42 so that the weight 42 is stably received within the groove 48. As such, like the eighth embodiment described above, the acoustic brace and/or tone bar 10''''' of the ninth illustrative embodiment does not comprise any weight support portions 28. In FIGS. 36 and 37, it can be seen that the generally flat ends 42*a*, 42*b* of the elongated cylindrical weight 42 are generally disposed at the highest points of each of the sloped upper surfaces of the first and second end portions 10*a*", 10*b*" of the acoustic brace and/or tone bar 10'''''. As shown in FIGS. 36-39, the elongated cylindrical weight 42 is secured to the acoustic brace and/or tone bar 10''''' by means of an elongated rectangular magnet 44 that is centrally disposed with respect to a longitudinal extending direction of the weight 42. The elongated rectangular magnet 44 comprises a top concave notch 46 disposed in the top surface thereof that corresponds, or substantially corresponds to the curvature of the outer circular wall of the elongated cylindrical weight 42 and to the curvature of the top concave groove 48 in the acoustic brace and/or tone bar 10''''. The elongated rectangular magnet 44 is received within a rectangular cavity or recess 50, which is disposed in the concave surface of the groove 48 of the acoustic brace and/or tone bar 10''''. When the elongated rectangular magnet 44 is inserted into the rectangular cavity or recess 50 in the concave surface of the acoustic brace and/or tone bar 10'''', the concave surface of the notch 46 aligns, or substantially aligns with the concave surface of the groove 48 of the acoustic brace and/or tone bar 10'''' so that the two concave surfaces are flush, or substantially flush with one another and the weight 42 is stably received within both grooves 46, 48. A magnetic attraction force is exerted on the elongated cylindrical weight 42 by the elongated rectangular magnet 44 so as to retain the elongated cylindrical weight 42 in place on the acoustic brace and/or tone bar 10''''. As best illustrated in FIGS. 36 and 37, the longitudinal extending direction of the elongated cylindrical weight 42 is parallel, or substantially parallel to the longitudinal extending directions of the acoustic brace and/or tone bar 10'''' and the elongated rectangular magnet 44 when the weight 42 is installed on the acoustic brace and/or tone bar 10''''. Advantageously, the use of the elongated rectangular magnet 44 to retain the elongated cylindrical weight 42 in place on the acoustic brace and/or tone bar 10'''' enables the weight 42 to be easily added and removed as desired by a user (e.g., so as to modify the resonant frequency of the instrument component to which it is attached). Because threaded fasteners are not used in the ninth illustrative embodiment for securing the elongated cylindrical weight 42 to the acoustic brace and/or tone bar 10'''', the elongated cylindrical weight 42, like the elongated rectangular bar weight 40 of the eighth illustrative embodiment, does not comprise the fastener apertures disposed therethrough.

It will be appreciated that particular ones of the acoustic weight systems illustrated above may possess characteristics that make them more suitable for a particular application in a musical instrument, as compared to other illustrative acoustic weight systems presented. For example, magnetic mounting means may be preferred in a particular musical instrument application over mounting means employing one or more threaded fasteners because weights secured by magnetic mounting means can be removed without manipulating a fastener. As another example, providing a plurality of weights on an acoustic brace and/or tone bar may be preferred over providing a single weight on the acoustic brace and/or tone bar because one of the plurality of weights can be removed, while leaving the one or more other weights on the brace and/or tone bar, thereby enabling the amount of weight applied to the brace and/or tone bar to be incrementally modified.

In one or more embodiments, the acoustic weight systems described herein are used to add weight to the back plate 120 or the curved sidewall 122 of the musical instrument 100 in order to make the resonant frequency of the back plate 120 equal to, or substantially equal to the resonant frequency of the top plate or soundboard 116. The acoustic weight systems are used to compensate for the fact that the top and bottom plates 116, 120 of instrument 100 typically resonate at different fundamental frequencies. That is, the bottom plate 120 normally vibrates at a higher frequency because it is stiffer than the top plate 116.

It is readily apparent that the aforedescribed acoustic weight systems and the stringed musical instrument 100 including the same offer numerous advantages. First, the acoustic weight systems described herein are capable of selectively raising and lowering the resonant frequency of the acoustic instrument plate or sidewall by the addition and removal of one or more weights. Secondly, each of the acoustic weight systems described herein include one or more weights that are capable of being easily attached to one or more acoustic braces, tone bars, or ribs. Finally, the stringed musical instrument 100 described herein, which includes an acoustic weight system, enables the resonant frequency of the acoustic instrument plate or sidewall to be easily adjusted by a user thereof. Advantageously, the acoustic weight systems described herein control the mode of vibration of the musical instrument without dampening the overtones of the instrument. Because the weights 20, 20', 32, 40, and 42 of the acoustic weight systems are disposed in the free space (i.e., the open cavity) of the instrument body 104, no sound damping or dampening results from the acoustic weight systems described herein.

Any of the features or attributes of the above described embodiments and variations can be used in combination with any of the other features and attributes of the above described embodiments and variations as desired. As used herein, the conjunction "and/or" means either one or both of the two stated possibilities (e.g., an "acoustic brace and/or tone bar" means either an acoustic brace or a tone bar, or both an acoustic brace and a tone bar).

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. An acoustic weight system for a stringed musical instrument, said acoustic weight system comprising:

one or more acoustic braces, tone bars, or ribs configured to be attached to one or more walls of a musical instrument body, each of said one or more acoustic braces, tone bars, or ribs having a first base surface, a second surface disposed opposite to said first base surface, and a thickness defined by a distance between said first base surface and said second surface; and one or more weights coupled to said one or more acoustic braces, tone bars, or ribs by attachment means, said one or more weights configured to be spaced apart from said one or more walls of a musical instrument body by said thickness of said one or more acoustic braces, tone bars, or ribs;

wherein said acoustic weight system is configured to change a resonant frequency of said one or more walls of said musical instrument body in order to modify a sound and/or tone of said stringed musical instrument.

2. The acoustic weight system according to claim 1, wherein said second surface of at least one of said one or more acoustic braces, tone bars, or ribs comprises a curved outer surface with one or more generally flat portions that provide mounting surfaces for respective ones of said one or more weights.

3. The acoustic weight system according to claim 1, wherein at least one of said one or more acoustic braces, tone bars, or ribs comprises a plurality of said weights coupled to said second surface of said at least one of said one or more acoustic braces, tone bars, or ribs.

4. The acoustic weight system according to claim 1, wherein at least one of said one or more weights comprises one of: (i) a disk-shaped weight, (ii) an elongated weight in the form of a rectangular bar, and (iii) an elongated weight in the form of a cylindrical rod.

5. The acoustic weight system according to claim 1, wherein said attachment means comprises one of: (i) a threaded fastener device, (ii) an adhesive, and (iii) one or more magnets.

6. A stringed musical instrument comprising, in combination:

a musical instrument body with a soundboard, one or more sidewalls, and a back wall, said soundboard being coupled to said one or more sidewalls;

a neck having a first end portion and a second end portion, said second end portion of said neck being coupled to said musical instrument body;

a plurality of strings extending from said first end portion of said neck to said soundboard of said musical instrument body; and an acoustic weight system including one or more acoustic braces, tone bars, or ribs attached to at least one of said one or more sidewalls and said back wall of said musical instrument body, said acoustic weight system further including one or more weights coupled to said one or more acoustic braces, tone bars, or ribs by attachment means, at least one of said one or more acoustic braces, tone bars, or ribs of said acoustic weight system comprising a curved outer surface with one or more weight support portions, each of said one or more weight support portions including a generally flat portion that provides a mounting surface for a respective one of said one or more weights, said acoustic weight system being configured to change a resonant frequency of said at least one of said one or more sidewalls and said back wall of said musical instrument body in order to modify a sound and/or tone of said stringed musical instrument.

7. The stringed musical instrument according to claim 6, wherein said one or more sidewalls of said musical instrument body comprise a curved sidewall extending about a periphery of said soundboard; and wherein said acoustic weight system comprises a plurality of said acoustic braces, tone bars, or ribs spaced apart along an interior surface of said curved sidewall of said musical instrument body, each of said plurality of said acoustic braces, tone bars, or ribs longitudinally extending in a height direction of said curved sidewall.

8. The stringed musical instrument according to claim 6, wherein said acoustic weight system comprises a plurality of said acoustic braces, tone bars, or ribs spaced apart along an interior surface of said back wall of said musical instrument body.

9. The stringed musical instrument according to claim 6, wherein at least one of said one or more weight support portions further includes a pair of spaced-apart generally planar sidewalls, each of said pair of spaced-apart generally planar sidewalls having diagonally extending sidewalls disposed on respective opposite sides thereof.

10. The stringed musical instrument according to claim 6, wherein at least one of said one or more acoustic braces, tone bars, or ribs of said acoustic weight system comprises a plurality of said weights coupled to a surface of said at least one of said one or more acoustic braces, tone bars, or ribs, each of said plurality of said weights being spaced apart from one another along a length of said at least one of said one or more acoustic braces, tone bars, or ribs.

11. The stringed musical instrument according to claim 10, wherein said at least one of said one or more acoustic braces, tone bars, or ribs of said acoustic weight system comprises a curved outer surface with a plurality of weight support portions, each of said plurality of weight support portions including a generally flat portion that provides a mounting surface for a respective one of said plurality of said weights.

12. The stringed musical instrument according to claim 6, wherein at least one of said one or more weights of said acoustic weight system comprises one of: (i) a disk-shaped weight, (ii) an elongated weight in the form of a rectangular bar, and (iii) an elongated weight in the form of a cylindrical rod.

13. The stringed musical instrument according to claim 6, wherein said attachment means of said acoustic weight system comprises one of: (i) a threaded fastener device, (ii) an adhesive, and (iii) one or more magnets.

14. The stringed musical instrument according to claim 13, wherein said attachment means of said acoustic weight system comprises a threaded fastener device in the form of a threaded screw or bolt with a plurality of external threads, said attachment means further comprising a threaded insert disposed in an aperture in said one or more acoustic braces, tone bars, or ribs, said threaded insert including a plurality of internal threads configured to threadingly engage with said plurality of external threads on said threaded screw or bolt.

15. The stringed musical instrument according to claim 13, wherein said attachment means of said acoustic weight system comprises a threaded fastener device in the form of a self-threading screw with a plurality of external threads, said plurality of external threads on said self-threading screw configured to engage with an interior surface of an aperture in said one or more acoustic braces, tone bars, or ribs.

16. The stringed musical instrument according to claim 13, wherein said attachment means of said acoustic weight system comprises one or more magnets, each of said one or more magnets received within an aperture or bore in said one or more acoustic braces, tone bars, or ribs.

17. A stringed musical instrument comprising, in combination:

a musical instrument body with a soundboard, one or more sidewalls, and a back wall, said soundboard being coupled to said one or more sidewalls;

a neck having a first end portion and a second end portion, said second end portion of said neck being coupled to said musical instrument body;

a plurality of strings extending from said first end portion of said neck to said soundboard of said musical instrument body; and an acoustic weight system including a plurality of acoustic braces, tone bars, or ribs attached to at least one of said one or more sidewalls and said back wall of said musical instrument body, each of said plurality of acoustic braces, tone bars, or ribs spaced apart along an interior surface of said at least one of said one or more sidewalls and said back wall, said acoustic weight system further including a plurality of weights coupled to said plurality of acoustic braces, tone bars, or ribs by attachment means, each of said plurality of acoustic braces, tone bars, or ribs comprising at least one of said plurality of weights coupled to a weight support portion of said acoustic brace, tonebar, or rib, said weight support portion of each said acoustic brace, tonebar, or rib comprising a generally flat portion that provides a mounting surface for said at least one of said plurality of weights, said acoustic weight system being configured to change a resonant frequency of said at least one of said one or more sidewalls and said back wall of said musical instrument body in order to modify a sound and/or tone of said stringed musical instrument.

* * * * *